US006934495B2

(12) United States Patent
Yoshino et al.

(10) Patent No.: US 6,934,495 B2
(45) Date of Patent: Aug. 23, 2005

(54) FINE PARTICLE STORAGE CONTAINER AND FINE PARTICLE STORAGE PRODUCT, TONER STORAGE CONTAINER AND TONER STORAGE PRODUCT, AND TONER SUPPLYING DEVICE

(75) Inventors: Masahiro Yoshino, Hamura (JP); Tatsuo Nakanishi, Sagamihara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 66 days.

(21) Appl. No.: 10/733,495

(22) Filed: Dec. 11, 2003

(65) Prior Publication Data

US 2004/0126144 A1 Jul. 1, 2004

(30) Foreign Application Priority Data

Dec. 17, 2002 (JP) ..... 2002-365006

(51) Int. Cl.[7] ..... G03G 15/08

(52) U.S. Cl. ..... 399/262; 222/DIG. 1

(58) Field of Search ..... 222/DIG. 1, 167, 222/168, 169; 399/120, 258, 262, 263

(56) References Cited

U.S. PATENT DOCUMENTS 6,731,897 B2 * 5/2004 Nagano et al. ..... 399/262

* cited by examiner

*Primary Examiner*—Hoang Ngo
(74) *Attorney, Agent, or Firm*—Lucas & Mercanti, LLP

(57) ABSTRACT

A fine particle storage container, including a first surface member on which plural grooves are carved in a radial pattern, and the plural grooves penetrate the first surface member from an interior side to a periphery, and a second surface member to be firmly fitted to the first surface member to seal the fine particle storage container, wherein gas in the fine particle storage container is ejected to the exterior of the fine particle storage container through the plural grooves, though the fine particles are not ejected through the plural grooves.

13 Claims, 14 Drawing Sheets

FINE PARTICLE STORAGE CONTAINER AND FINE PARTICLE STORAGE PRODUCT, TONER STORAGE CONTAINER AND TONER STORAGE PRODUCT, AND TONER SUPPLYING DEVICE

BACKGROUND OF THE INVENTION

The present invention relates to a container for storing fine particle, and a product for storing fine particle, and also to a container for storing toner, a product for storing toner, and a device for supplying toner all of which are loaded in an electrophotographic image forming apparatus such as a copying machine or a printer, as a form of a cartridge.

Concerning the method for supplying toner to an image forming apparatus of employing electrophotography, there are several kinds of types which are not only a toner cartridge wherein the toner storing cartridge itself is loaded in an image forming apparatus, but also the container which is opened and the contained toner is supplied to the image forming apparatus. These toner storage containers are designed in such a way that the operator's hands or the interior of the image forming apparatus do not become dirty when the toner is supplied to the image forming apparatus.

In recent years, containers have been made of resins, being resistant to deformation or brockage, and can be recycled. When the toner storage container is retrieved after use, toner is again filled into the retrieved container, and the container is shipped to be circulated, which is predominantly the current system. Further, the resin container has stability of size, and excellent sealing performance, spillage of toner from the container is very rare.

However, when the storage container is filled with toner in a factory, the interior pressure of the storage container is kept at the pressure in the factory, and when temperature rises at the user's location, the interior pressure of the stored contents may rise higher than the ambient pressure. When the storage container is opened during installation, toner in the storage container will be expelled strongly by the pressure difference, and the expelled toner will pollute the user and the apparatus. Therefore, when the user changes the cartridge whose interior pressure is high on a hot day during the summer season, the problems of pollution exist.

Further, among the various kinds of fine particles or grainy materials, for example, edible powder such as ground coffee beans or instant juices, these materials may produce gas during storage. If the gas generated from the stored fine particles or grainy materials is not expelled from the storage container before opening, there is a strong possibility that the interior of the storage container will expand and be destroyed, which lessens the commercial value of the fine particles or grainy materials.

For the above-mentioned problems, in order to reduce the interior pressure of the storage container, proposed have been an air permeable film or a venting valve incorporated with the storage container, or a lid member formed of a flexible material or a porous material. However, due to additional new parts or an increase in the number of manufacturing processes, a rise in cost is unavoidable.

Further, by using a means which does not generate a pressure difference between interior and exterior of the container, resulting in exposal of the fine particles into the environment for a relatively long period, it is not preferable from the view point of conservation of quality of the product over a long term. For example, in case of toner for electrophotography, the electrostatic property of the toner is changed under influence of the external environment. When a cartridge storing such toner is employed for the image forming apparatus, it is not possible to obtain an expected high quality of the image, because the toner's electrostatic property has been altered. Further, in case of food products such as powdered juice, taste will be different, because of quality deterioration through oxidization.

Concerning the matter that the interior pressure of the container becomes higher, proposed has been a method wherein the interior pressure of the container is reduced. For example, in patent document 1, disclosed is technology wherein when the interior pressure of the container is increased, an air passing condition is partially formed by use of a wall of a cap which can be elastically deformed, and which in turn decreases the interior pressure.

[patent document 1] TOKKAIHEI 6-208301

However, according to the technology disclosed in patent document 1, it is understood that the degree of deformation of the cap wall varies so widely that it is not possible to effectually reduce the interior pressure, or too much deformation occurs and the toner is expelled.

Further, there is a method wherein an air permeable material is attached on the container to reduce the interior pressure of the container, however this method requires an additional member to be attached, which increases the production cost and the number of manufacturing processes, still further, the container is easily affected by exterior conditions, because of the permeability of air, and thereby it is very difficult to maintain the quality of the contained fine particles, over the long term. In the case of toner for electrophotography, for example, the electrostatic property is changed so greatly that the expected high quality of the image cannot be obtained, resulting in unacceptable image formation. Further, in the case of the finely ground food, the quality of the food can be severely deteriorated by oxidization.

As mentioned above, in the case of the finely ground products to be stored such as fine particle toner, it is very difficult technology to stably maintain the quality of the stored fine particles over the long term, and to reduce the difference of pressure between the interior and exterior of the container, and further to prevent expelling of the fine particles from the container when the container is opened.

SUMMARY OF THE INVENTION

The present invention has been achieved to solve the above-mentioned problems. That is, when there is a difference of pressure between the interior and the exterior of the container, extra gas in the container is expelled, and the pressure difference between the interior and the exterior of the container is moderately reduced to prevent the expelling of the fine particles by the present invention. Further, the present invention provides a fine particle storage container which does not generate stains caused by the expelling of the fine particles, and still further, a toner storage container which does not generate stains caused by the expelling of toner.

Another objective of the present invention is to provide a fine particle storage container and a toner storage container, as well as a fine particle storage product and a toner storage product which are able to maintain the quality of the stored fine particles for a long term without adversely affecting the fine particles in the container, even though having the means for decreasing the pressure difference between the interior and exterior of the container, and further which are economically efficient without increasing the number of parts and man-power of the container production.

After studying the above objectives, the inventors of the present invention hit on the idea that it is possible to attain the above objectives by the technology described in any one of following structures.

Structure 1.

A fine particle storage container, including; a first member, and a second member firmly pressure fitted to the first member, wherein plural grooves are formed from the interior to the exterior on the pressure fitted surface of the first member or the second member, and wherein the width of the grooves on the exterior side of the fine particle storage container is smaller than that of the interior side of the fine particle storage container.

Structure 2.

A fine particle storage container, including; a first member, and a second member firmly pressure fitted to the first member, wherein plural grooves are formed from the interior to the exterior on the pressure fitted surface of the first member or the second member, and wherein the groove is formed gradually shallower from the interior to the exterior of the fine particle storage container.

Structure 3.

The fine particle storage container described in structure 1 or 2, wherein the groove is a means for expelling gas from the fine particle storage container.

Structure 4.

The fine particle storage product, composed of a fine particle storage container in which fine particles are stored, described in any one of structures 1–3.

Structure 5.

A toner storage container, including; a main container body for storing toner, and an interior cap member which is firmly fitted onto the main container body and which functions to open or close a mouth section of a toner supplying section, wherein plural grooves are formed from the interior to the exterior of pressure fitted surface between the main container body and the interior cap member, and wherein the width of the groove is tapered gradually narrower from the interior to the exterior of the fine particle storage container.

Structure 6.

A toner storage container, including; a main container body for storing toner, and an interior cap member which is firmly pressure fitted to the main container body and which functions to open or close a mouth section of a toner supplying section, wherein plural grooves are formed from the interior to the exterior on an engaged surface between the main container body and the interior cap member, and wherein the depth of the groove is gradually shallower from the interior to the exterior of the fine particle storage container.

Structure 7.

The fine particle storage container described in structure 5 or 6, wherein the grooved section is a means for expelling gas from the fine particle storage container.

Structure 8.

The fine particle storage container described in structure 5 or 6, wherein the width or depth of the grooved section is greater than the diameter of the fine particles stored in the fine particle storage container.

Structure 9.

The toner storage product, including the toner storage container described in any one of structures 5–8, wherein the toner for developing an electrostatic latent image is stored.

Structure 10.

A toner supplying device wherein the toner storage container described in any one of structures 5–8 is loaded, and the toner supplying device supplies the toner expelled from the toner storage container, to a developing device.

BRIEF DESCRIPTION OF THE DRAWINGS

FIG. 1(*b*) is a plane view showing a toner supplying device, a toner storage container, and a developing device of an image forming apparatus.

FIG. 5(*b*) is a bottom view of the toner ejecting cap.

FIG. 5(*c*) is an elevation view of a toner ejecting cap.

FIG. 6(*b*) is a sectional drawing of a mouth section of a toner supplying section, from which the cap has removed.

FIG. 7(*b*) is a sectional view of a toner ejecting cap of a container.

FIG. 8(*b*) is an enlarged partial plane view of a grooved section.

FIG. 8(*c*) is an enlarged partial plane view, showing another embodiment of a grooved section.

FIGS. 9(*c*) and 9(*d*) are an enlarged partial sectional views showing the other embodiments of the grooved section.

FIG. 10(*b*) is a perspective view of a bottom cap.

DETAILED DESCRIPTION OF THE PREFERRED EMBODIMENT

Figure 1:
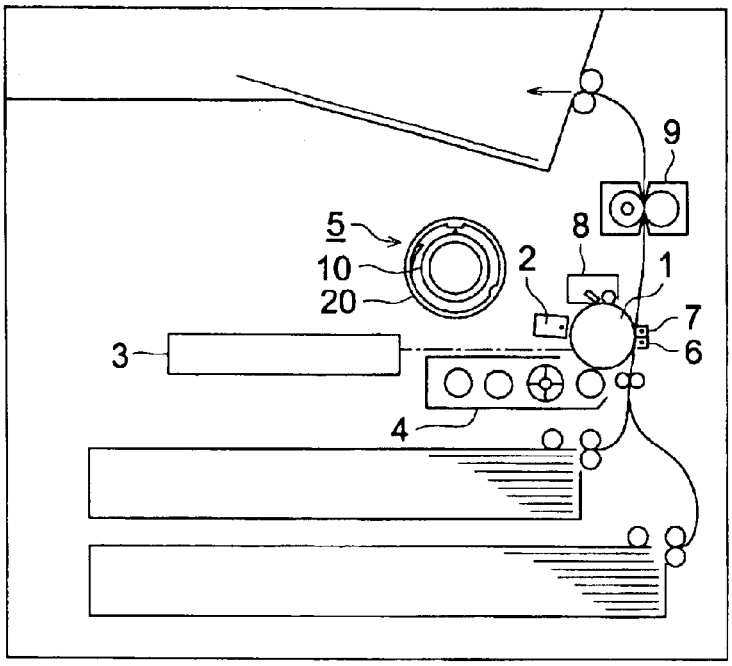
FIG. 1(*a*) is an overall structural drawing of a plain paper copier representing an image forming apparatus in which a toner storage container and a toner supplying device are provided.
Figure 1:
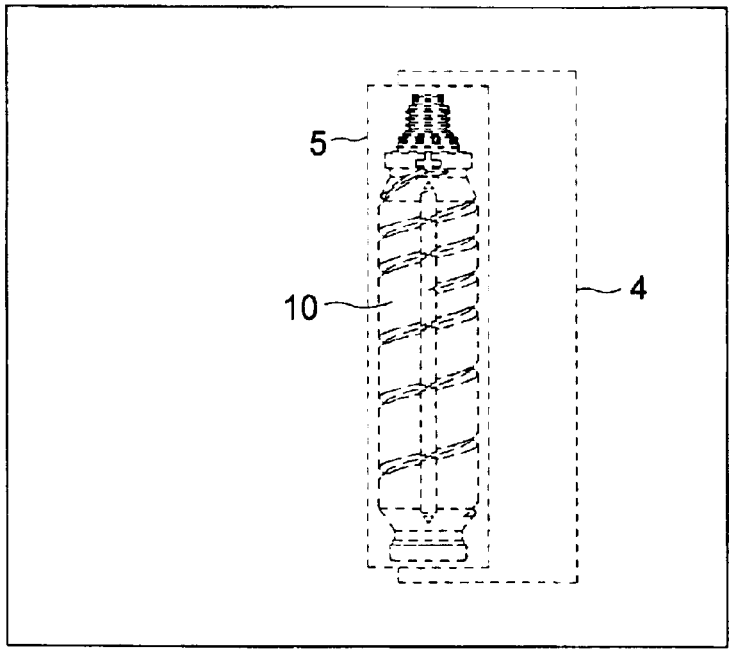

Preferred embodiments of the toner storage container of the present invention will be described in detail below, while referring to the drawings. This invention is however not limited to these embodiments.

FIG. 1(*a*) is an overall structural drawing of a plain paper copier representing an image forming apparatus on which toner storage container (hereinafter referred to as storage container) 10 and toner supplying device 5 are provided.

FIG. 1(*b*) is a plane view showing storage container 10, toner supplying device 5, and developing device 4 of an image forming apparatus.

Around drum-shaped photoreceptor 1 which is provided nearly centered in the main body of a plain paper copier, around which are arranged charging device 2, exposure device 3, developing device 4, toner supplying device 5, transfer device 6, separating device 7 and cleaning device 8, while fixing device 9 is arranged above photoreceptor 1.

On toner supplying device 5 in FIG. 1(*a*), fixed is supporting member (hereinafter referred to as container supporting member) 20 which supports storage container 10, and further container supporting member 20 is connected to developing device 4. Rotating container supporting member 20 supports nearly horizontally storage container 10 containing toner, related to the present invention.

Figure 2:
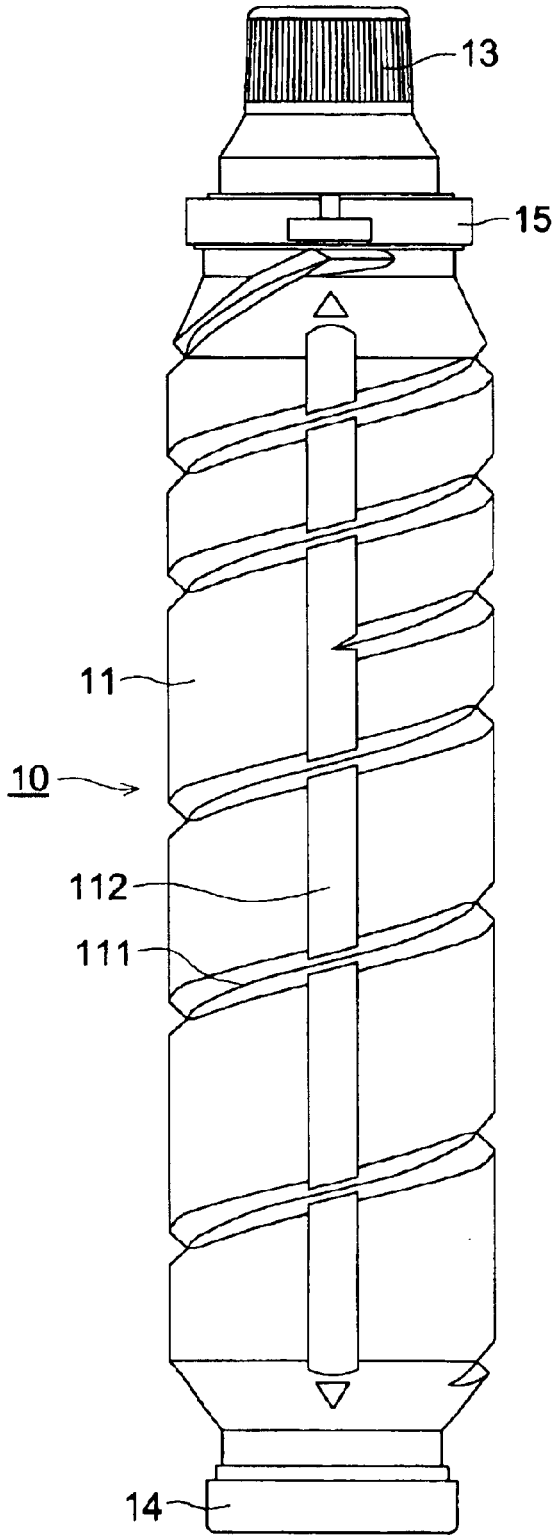
FIG. 2 is a drawing of the exterior of a toner storage container.
Figure 3:
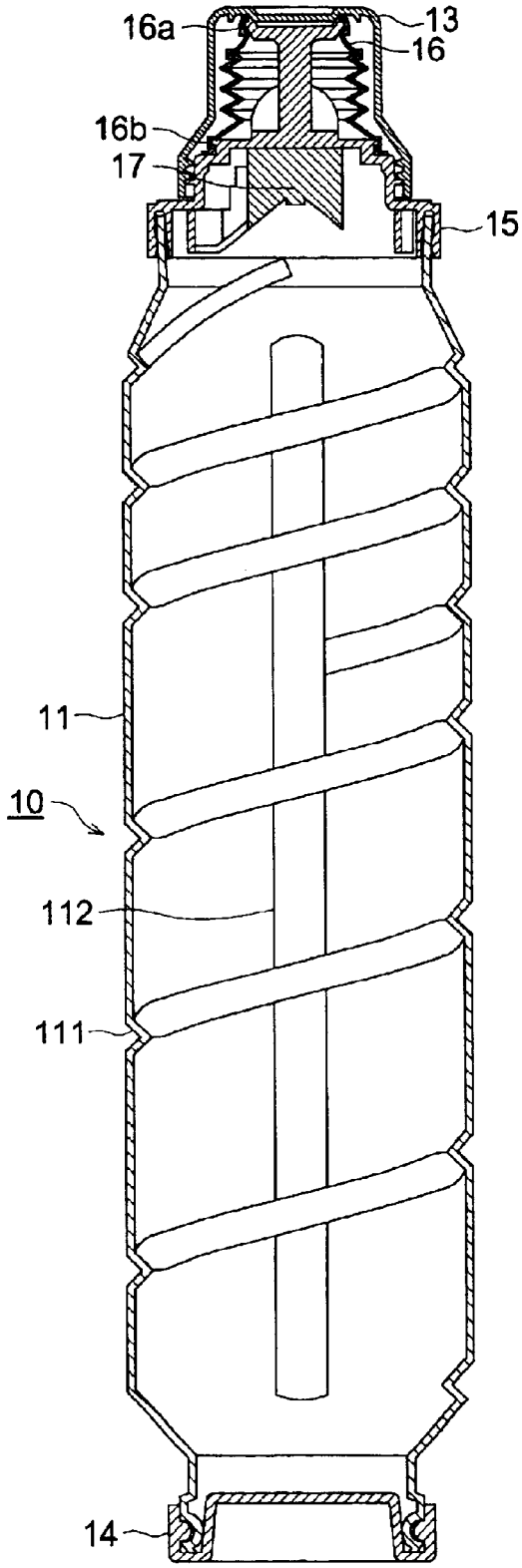
FIG. 3 is a sectional drawing of a toner storage container.
Figure 4:
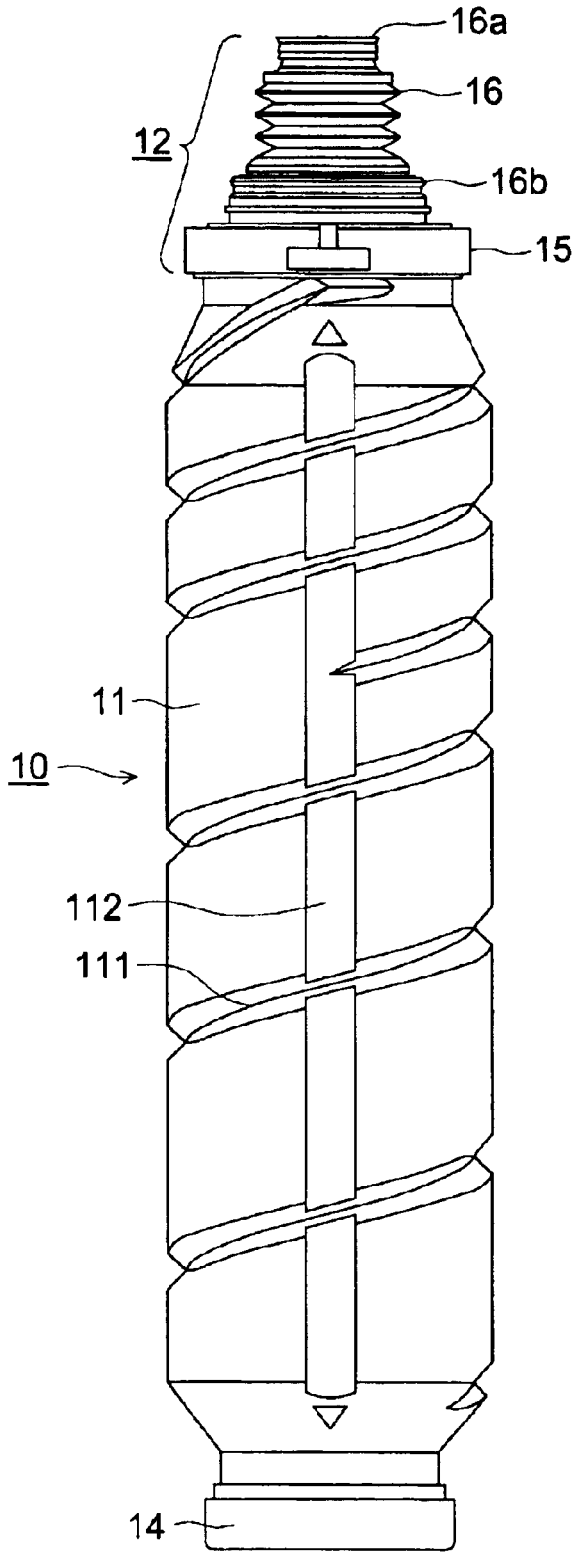
FIG. 4 is a drawing of the exterior of a toner storage container on which the cap is removed from the mouth section of the toner supplying section.

FIG. 2 is a drawing of the exterior of storage container 10, showing covering cap 13 for closing toner supply mouth section 12 mentioned later. FIG. 3 is a sectional drawing of storage container 10. FIG. 4 is a drawing of the exterior of storage container 10 from which cap 13 has been removed from toner supplying mouth section 12.

Cylindrical storage container 10 is composed of main container body 11, bottom cap 14, toner ejecting cap 15, and interior bellows cap (interior cap member, which is called the second member) 16. Toner supplying mouth section 12 is composed of toner ejecting cap (the first member) 15 engaged with one of the end of main container body 11, and interior bellows cap 16.

Main container body 11 has concave spiral groove 111 which is concaved on the peripheral surface of the cylindrical surface of main container body 11, which is convex on the interior surface of the cylindrical section of the container. There are several concave spiral grooves near the toner ejecting outlet.

Further, on the peripheral surface of main container body 11, straight groove 112, crossing over spiral groove 111, is aligned with the axis of main container body 11 (that is, straight groove 112 is formed in the axial direction of the cylindrical container).

The rear opening, which is opposite the toner ejecting outlet at the top of cylindrical main container body 11, is closed by bottom cap 14.

Toner supplying mouth section 12 is arranged at the top of main container body 11 of storage container 10, as shown in FIG. 4. Toner supplying mouth section 12 is composed of toner ejecting cap 15 directly engaged with main container body 11 of storage container 10, and extensible interior bellows cap 16 which is able to open/close a toner ejecting opening of toner ejecting cap 15.

Figure 5:
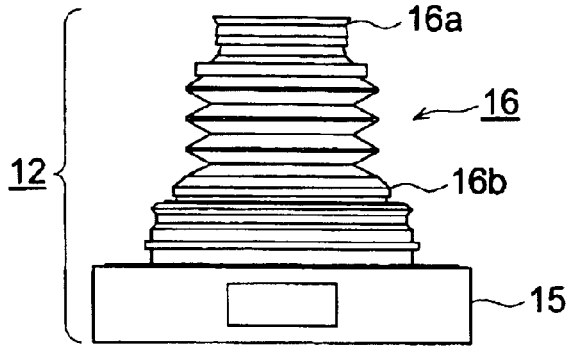
FIG. 5(*a*) is an elevation view of the mouth section of the toner supplying section.
Figure 5:
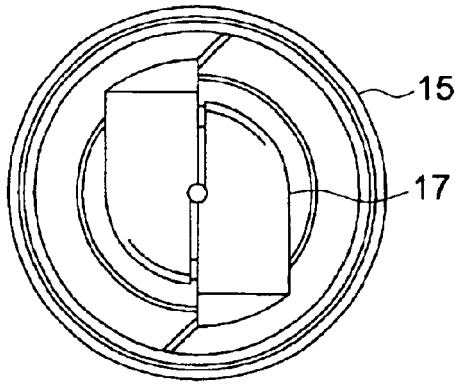
Figure 5:
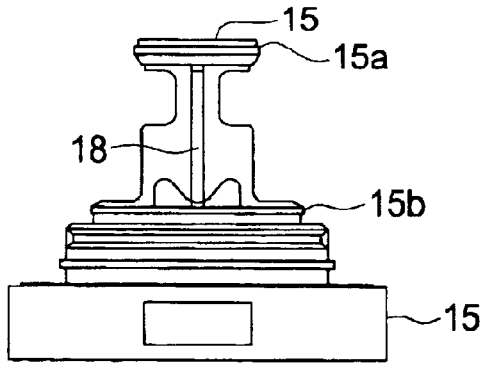

FIG. 5(*a*) is an elevation view of toner supplying mouth section 12, FIG. 5(*b*) is a bottom view of toner ejecting cap 15, and FIG. 5(*c*) is an elevation view of toner ejecting cap 15 from which interior bellows cap 16 has been removed.

Toner supplying mouth section 12 is composed of interior bellows cap 16, and toner ejecting cap 15 which is directly engaged with main container body 11, as shown in FIGS. 4 and 5(*a*). As shown in FIGS. 3 and 5(*b*), paddle-type and sloped auger sections 17 are integrally formed in toner ejecting cap 15.

Figure 13:
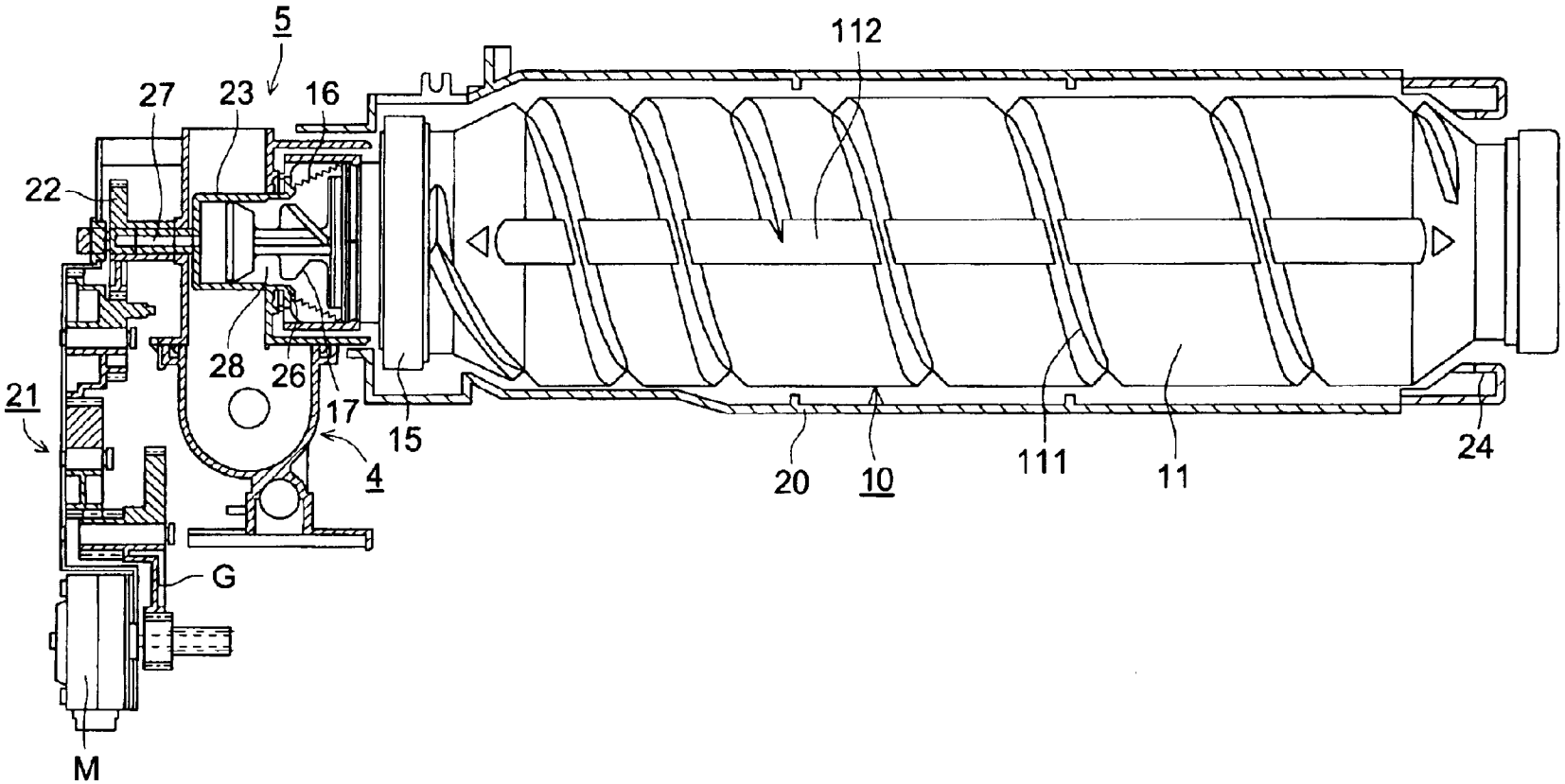
FIG. 13 is a sectional view of a toner supplying device into which a toner storage container is loaded.

As shown in FIG. 13, auger section 17 is formed in such a way that sloped parts cross. Toner which has been conveyed is further conveyed by spiral groove 111 to auger section 17, then toner slides downward on the sloped parts, and is conveyed to toner ejecting outlet 28 (see FIG. 13), and from where toner is finally supplied to developing device 4 via toner ejecting outlet 28. That is, in order to convey and eject toner from storage container 10 to toner ejecting outlet 28, auger section 17 leads toner to ejecting outlet 28, and that is, auger section 17 is structured so as to scrape toner which has been conveyed by the rotation of cylindrical storage container 10, and toner held on auger section 17 is discharged to ejecting outlet 28. The top of auger section 17 is arranged at the position corresponding to the convex section of spiral groove 111.

As shown in FIGS. 3 and 4, interior bellows cap 16 appears, when cap 13 screwed in toner ejecting cap 15, is unscrewed. In FIGS. 5(*a*) and 5(*c*), under the condition that cap 13 has been unscrewed, top section 16*a* of interior bellows cap 16 is brought into contact with top edge section 15*a* of toner ejecting cap 15, and thereby, top section 16*a* and top edge section 15*a* become detachably engaged. Lower section 16*b* of interior bellows cap 16 is tightly engaged with lower edge section 15*b* of toner ejecting cap 15.

Figure 6:
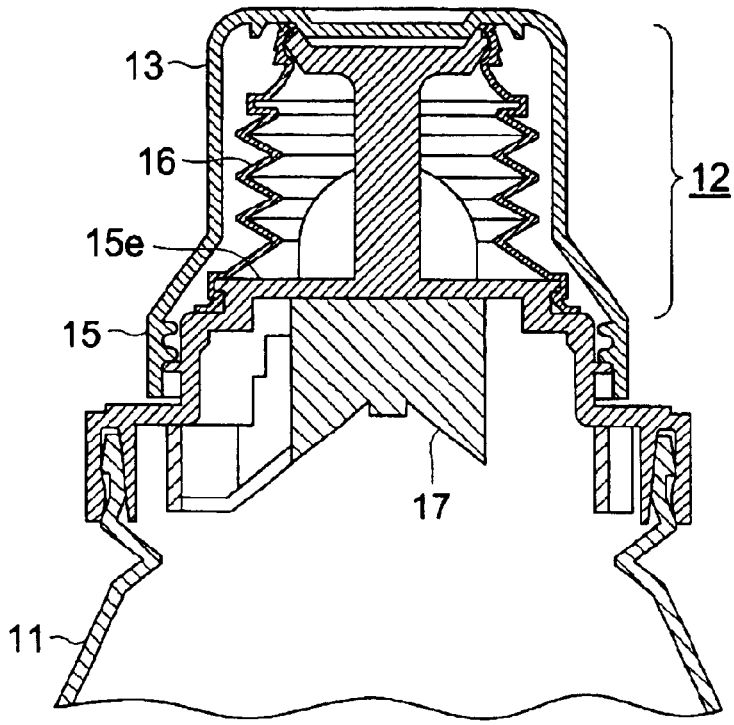
FIG. 6(*a*) is a sectional drawing of the mouth section of a toner supplying section, on which a cap is set.
Figure 6:
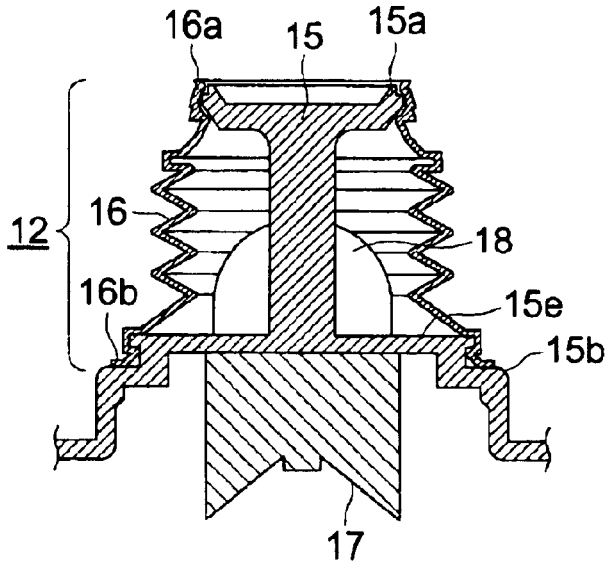

FIG. 6(*a*) is a sectional drawing of toner supplying mouth section 12 wherein cap 13 is set on storage container 10 of the present invention, and FIG. 6(*b*) is a sectional drawing of toner supplying mouth section 12 from which cap 13 has been removed.

When cap 13 is fitted onto toner supplying mouth section 12, cap 13 is pushed down firmly onto interior bellows cap 16.

Even when storage container 10 of the present invention is kept under the condition that the pressure difference occurs at the interior and exterior of storage container 10, top section 16*a* of interior bellows cap 16 is in close contact with top edge section 15*a* of toner ejecting cap 15 by cap 13, and thereby, toner is not expelled so that the interior of cap 13 is not stained by toner.

As clarified by FIGS. 6(*a*) and 6(*b*), when cap 13 is removed, interior bellows cap 16 is released from the pressed condition, and thereby, top section 16*a* of interior bellows cap 16 is in contact with top edge section 15*a* of toner ejecting cap 15. As clarified by FIG. 6(*b*), lower section 16*b* of interior bellows cap 16 is always in close contact with lower edge section 15*b* of toner ejecting cap 15.

Figure 7:
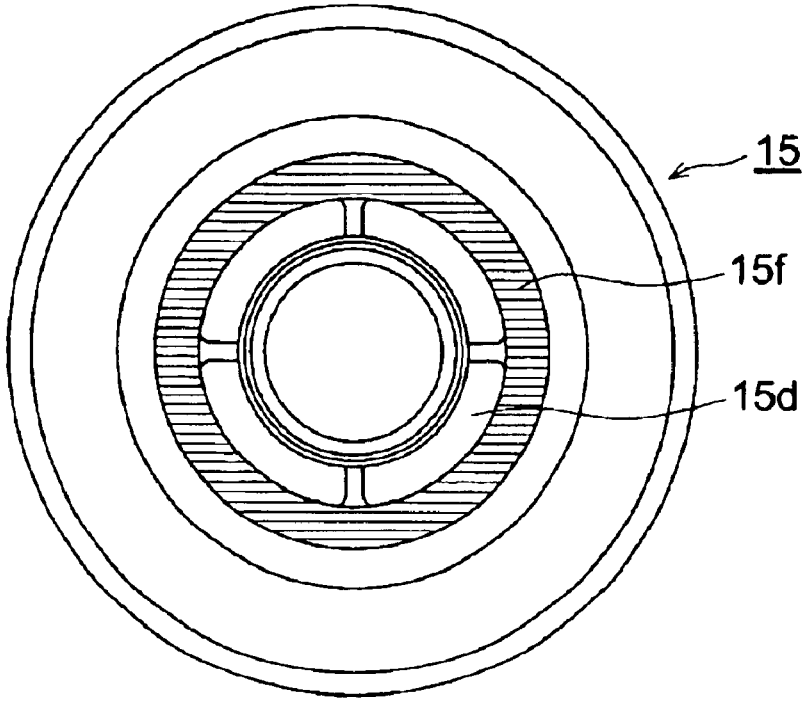
FIG. 7(*a*) is a plane view of a toner ejecting cap of a container.
Figure 7:
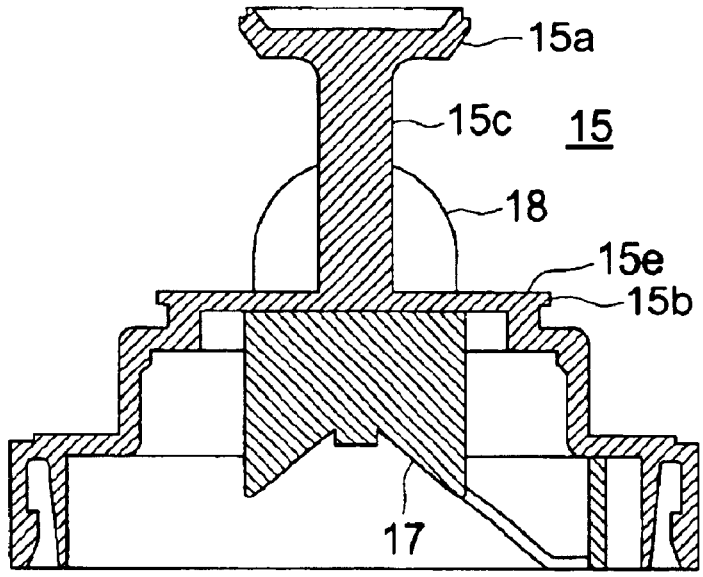

FIG. 7(*a*) is a plane view of toner ejecting cap 15 of storage container 10 of the present invention, and FIG. 7(*b*) is a sectional view of toner ejecting cap 15.

In FIG. 7(*b*), disk-shaped top edge section 15*a* is integral with leg section 15*c*. Top section 16*a* of interior bellows cap 16 is detachably engaged with the periphery section of top edge section 15*a*.

Disk-shaped lower edge section 15*b* is formed on the base section of leg section 15*c*. Lower section 16*b* of interior bellows cap 16 is screwed onto the periphery of lower edge section 15*b*. Further, aperture 15*d* is formed in lower edge section 15*b*. Aperture 15*d* allows toner stored in main container body to pass and be ejected.

Lower section (that is a second surface member) 16*b* of interior bellows cap 16 is in pressure-contact with disk plate surface (that is a first surface member, jointing surface) 15*e* of lower edge section 15*b*. Plural narrow grooves 15*f* are parallel to each other and carved on disk plate surface 15*e*. Grooves 15*f* are straight grooves communicating with aperture 15*d*, which penetrates to storage container 10, and continues to the periphery of disk plate surface 15*e*. When the top of toner ejecting cap 15 is closed by interior bellows cap 16, grooves 15*f* restrict the ejection of toner from storage container 10 and allows the gas in storage container 10 to exit storage container 10.

By forming grooves 15*f* to be parallel, an injection forming die, by which toner ejecting cap 15 is formed, can be removed in one direction, when the injection forming die is employed for manufacturing, and thereby, toner ejecting cap 15 can be easily formed, which is an advantage.

Figure 8:
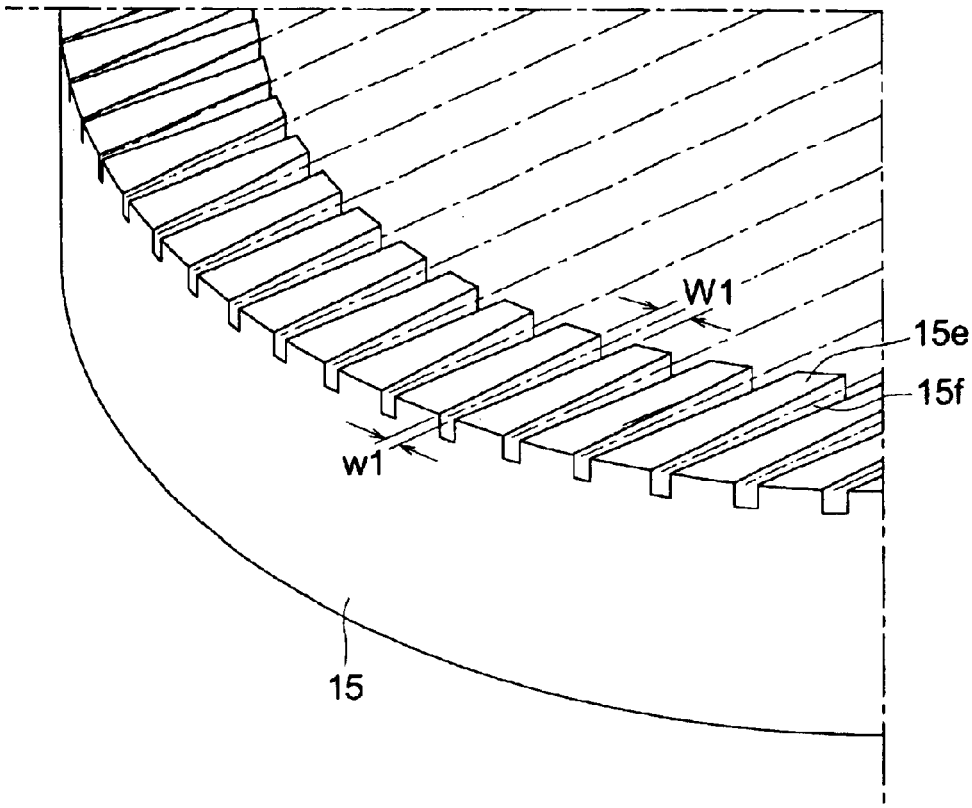
FIG. 8(*a*) is an enlarged partial perspective view of the toner ejecting cap.
Figure 8:
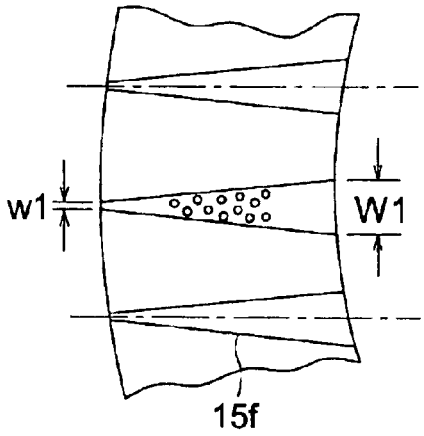
Figure 8:
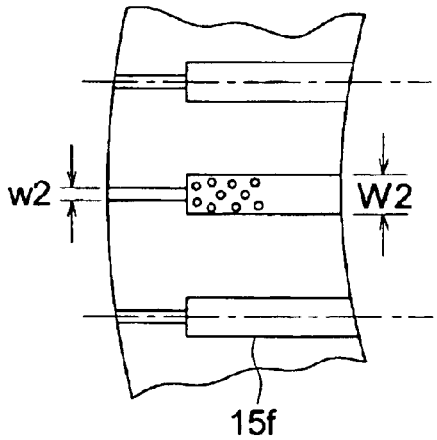

FIG. 8(*a*) is an enlarged partial perspective view of toner ejecting cap 15, and FIG. 8(*b*) is an enlarged partial plane view of grooves 15*f*.

Grooves 15*f* are formed on disk plate surface 15*e* of toner ejecting cap 15. Concerning the plane shape of grooves 15*f*, the width of the grooves 15*e* is tapered in such a way that minimum width w1 of grooves 15*f* at the peripheral edge of disk plate surface 15*e* is less than maximum width W1 of the grooves 15*f* at the inner edge of disk plate surface 15*e*.

Grooves 15*f* are a means for ejecting the gas from storage container 10. Minimum width w1 is set to be greater than the diameter of toner particles stored in storage container 10. For example, when the diameter of toner is 6–16 $\mu$m, minimum width w1 of grooves 15*f* is approximately 30 $\mu$m.

Plural toner particles which have entered grooves 15*f* intertwine with each other, and tend to stay near an intermediate position of grooves 15*f*, and thereby, plural toner particles are not ejected from minimum width w1 of grooves 15*f*, but gas can be ejected.

FIG. 8(*c*) is an enlarged partial plane view, showing another embodiment of grooves 15*f*. Grooves 15*f* are composed of grooves of maximum width W2 through which both toner particles and gas can pass, and grooves of minimum width w2 through which only gas can pass.

Figure 9:
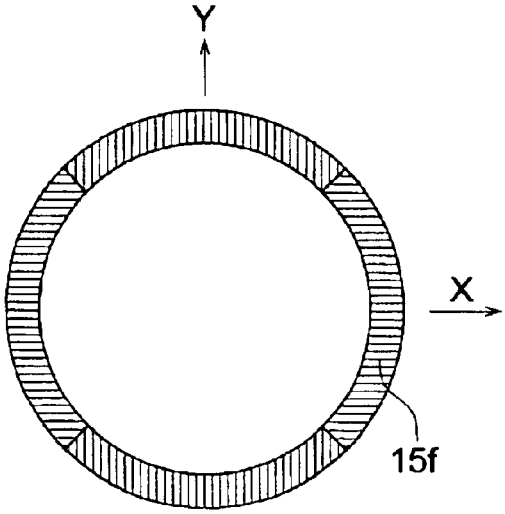
FIGS. 9(*a*) and 9(*b*) are plane views showing still other embodiments of the grooved section.
Figure 9:
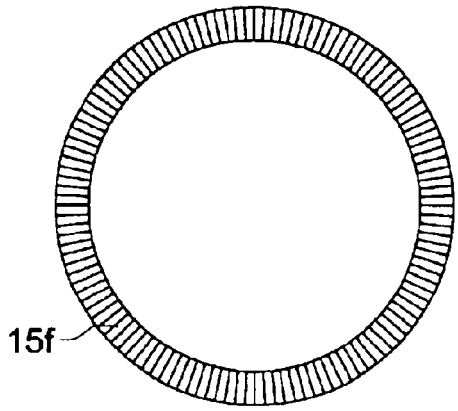
Figure 9:
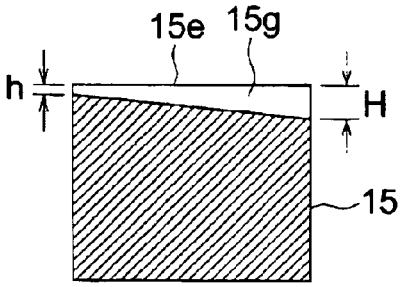
Figure 9:
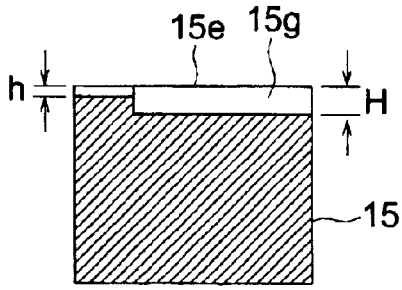

FIG. 9(*a*) is a plane view showing another embodiment of grooves 15*f*. Grooves 15*f* are formed in directions X and Y, shown in FIG. 9(*a*). Thereby, the gas can be ejected more effectively from grooves 15*f*.

FIG. 9(*b*) is a plane view showing a further embodiment of grooves 15*f*. Grooves 15*f* are formed in a radial pattern, whereby, the gas can be ejected more effectively from grooves 15*f*.

FIG. 9(*c*) is an enlarged partial sectional view showing another embodiment of the grooves. Plural narrow grooves 15*g* are formed on disk plate surface 15*e* of toner ejecting cap 15. The depth of grooves 15*g* is tapered in such a way that minimum depth h of grooves 15*g* at the outer peripheral edge of disk plate surface 15*e* is less than maximum depth H of grooves 15*g* at the inner peripheral edge of disk plate surface 15*e*.

FIG. 9(*d*) is an enlarged partial sectional view showing another embodiment of grooves 15*g*. Grooves 15*g* are composed of deeper grooves of maximum depth H through which both the toner particles and gas can pass, and shallower grooves of minimum depth h through which only gas can pass.

Concerning the shape of grooves 15*g* formed on disk plate surface shown in FIGS. 9(*c*) and 9(*d*), the width shape can be the parallel groove of minimum width w2 shown in FIG. 8(*c*), or the tapered form w1–W1 shown in FIG. 8(*b*).

Figure 10:
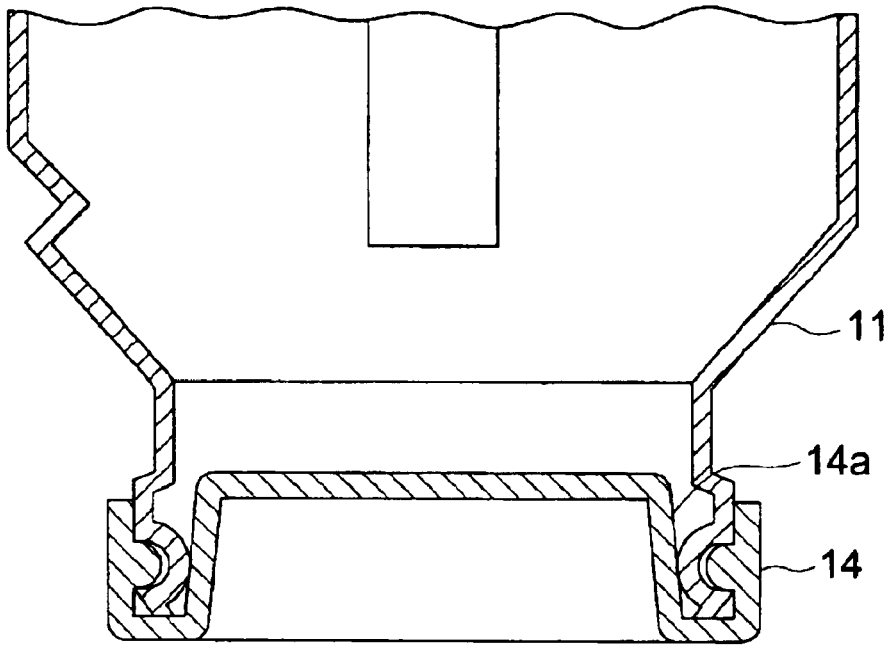
FIG. 10(*a*) is a partial sectional view of an engaging section between the bottom of a main container body and a bottom cap of the storage container.
Figure 10:
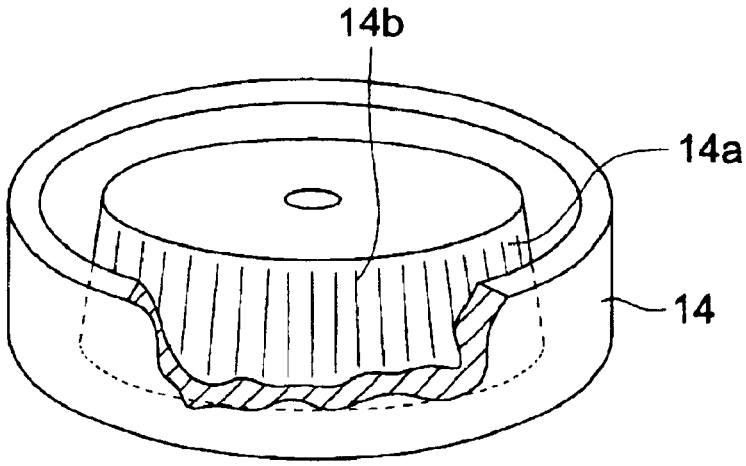

FIG. 10(*a*) is an enlarged partial sectional view of the engaging section between the bottom section of main container body (a second member of the rear section) 11 of storage container 10 and a bottom cap (a first member of the rear section) 14 of main container body 11 of storage container 10. FIG. 10(*b*) is a perspective view of a bottom cap 14.

Grooves 14*b* for gas ejection are formed in side surface 14*a* by which bottom cap 14 is engaged with the end of main container body 11. Grooves 14*b* are composed of a plurality of grooves which are parallel with the axis of rotation of storage container 10, and are formed on the peripheral surface of side surface 14*a*.

Figure 11:
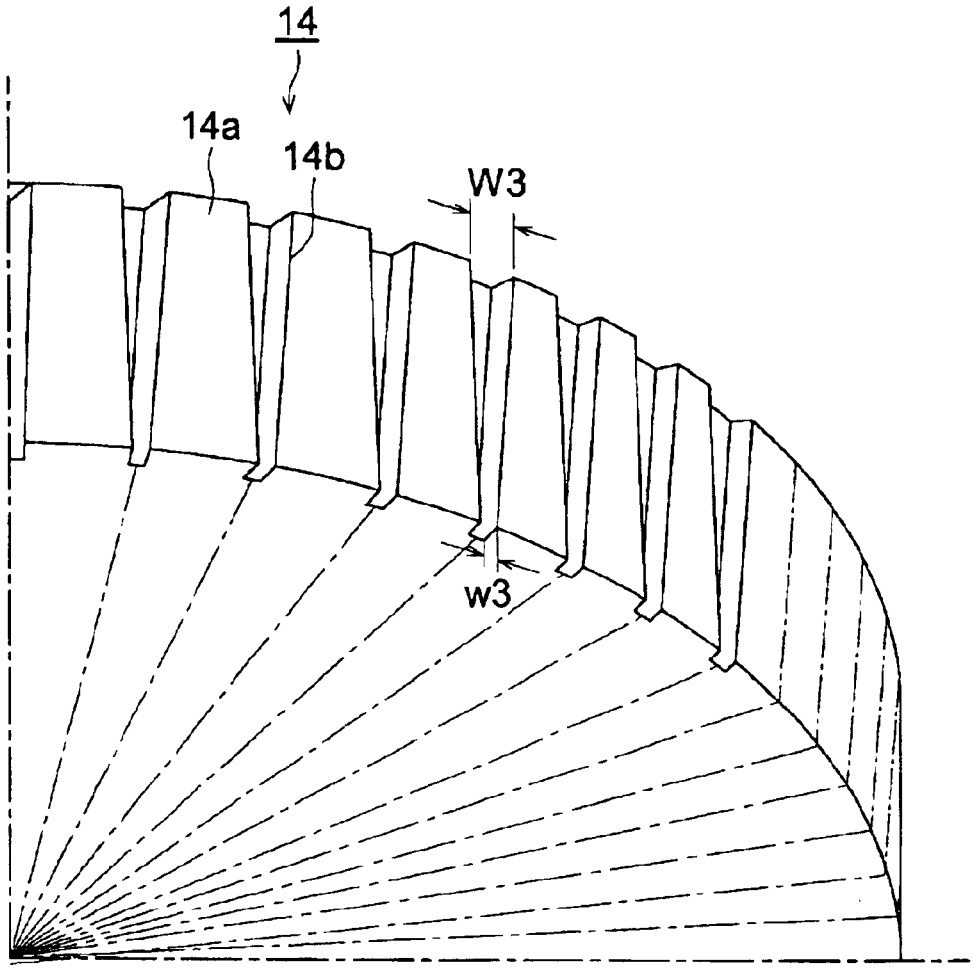
FIG. 11 is an enlarged partial perspective view of a bottom cap.

FIG. 11 is an enlarged partial perspective view of bottom cap 14. Grooves 14*b* are the route for expelling gas, wherein the width of the groove is tapered from maximum width W3 at the inner side of main container body 10, to minimum width w3 near the outer side of main container body 10.

Employing the gas ejecting function of grooves 15*f* and 15*g* formed on disk plate surface 15*e* in FIGS. 9(*c*) and 9(*d*), and grooves 14*b* formed on bottom cap 14 in FIG. 10(*b*), gas in storage container 10 is communicated to ambient gas, therefore even though storage container 10 is left in an environment of high temperature or at high altitudes of lower pressure where a pressure difference between interior and exterior portion of storage container 10 occurs, toner cannot be expelled.

That is, even when cap 13 is attached, toner is not adhered to the inside of cap 13. Further, even when cap 13 is removed, toner is not expelled from the clearance between top section 16*a* of interior bellows cap 16 and top edge section 15*a* of toner ejecting cap 15, whereby it is possible to prevent the user or the apparatus from being stained by toner.

When the storage temperature is changed from 30° C. to 50° C., storage container 10 of the present invention does not expel extra gas through grooves 15*f*, until the pressure difference between the interior and exterior of the container is 3.5 kPa. Further it has been learned that storage container 10 of the present invention does not expel toner through the clearance between top section 16*a* of interior bellows cap 16 and top edge section 15*a* of toner ejecting cap 15.

Still further, in storage container 10 of the present invention, it has been learned that the environment in storage container 10 can be maintained up to a certain pressure value, by adjusting the width of the groove.

Still further, in storage container 10 of the present invention, the toner stored in storage container 10 from which gas has been expelled, is kept without the change of the quality. The inventor of the present invention recognized that the electrostatic property of the toner stored in storage container 10 from which gas has been expelled, is maintained without change, and thereby any subsequent image quality is unaffected. The following experiment was conducted. Storage container 10 from which gas had been expelled was stored under high temperature of 30° C. and high humidity of 80% for a long time period, and the electrostatic property of the stored toner was measured, after which the toner was used in an image forming apparatus to make image copies. In result, the electrostatic property was maintained and a high quality image copy was produced.

As described above, by using the container of the present invention, it was learned that fine particle products stored in storage container 10 from which gas had been expelled was barely influenced by ambient humidity. However it is not clear why the air tightness is achieved in the storage container 10, even when gas has been expelled. However, the expelling means employed in storage container 10 of the present invention has the nature to exercise the permeability of air, when the pressure difference between the exterior and interior of storage container 10 exceeds a certain value, that is, it is thought a certain value of the pressure difference is absolutely necessary.

Figure 12:
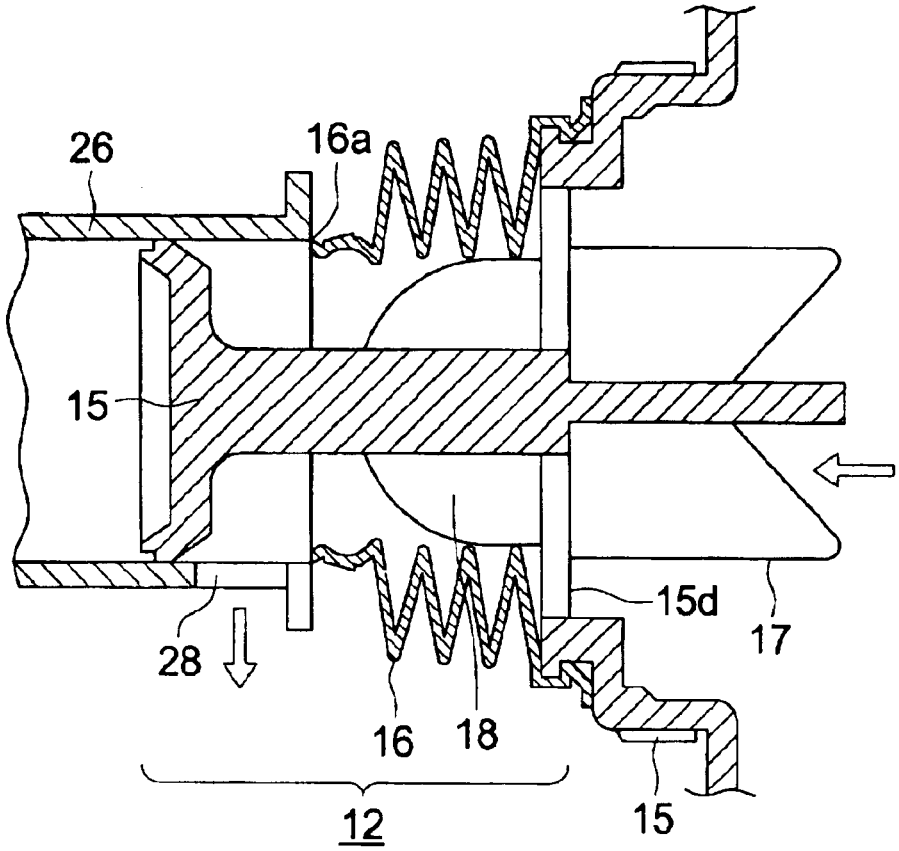
FIG. 12 is a partial sectional view of the mouth section of a toner supplying section, which shows the expelling state of the toner.

FIG. 12 is a partial sectional view of toner supplying mouth section 12, which shows the expelling state of the toner. When storage container 10 is installed onto a toner supplying device, to be mentioned later, interior bellows cap opening/closing claw 26 (hereinafter referred to as claw 26) presses on top section 16*a* of interior bellows cap 16 to open toner ejecting outlet 28.

Next, when toner ejecting cap 15 is rotated, by a not illustrated driving means, main container body 11 incorporated with toner ejecting cap 15 is rotated, then the toner stored in main container body 11 is agitated by concave spiral groove 111 and conveyed to toner ejecting cap 15, and further conveyed into interior bellows cap 16 by auger sections 17. The toner conveyed into interior bellows cap 16 is conveyed by sloped agitation paddles 18 and ejected through toner ejecting outlet 28, and further supplied to developing device 4.

In the present invention, arranged is a gas expelling means composed of the grooves through which gas is expelled from the interior of storage container to the exterior of the same, by means of pressure difference between the interior and exterior of storage container 10 having at least one engaging section. When the pressure in storage container 10 is higher than the ambient pressure, the extra gas in storage container 10 is mildly ejected to the exterior of storage container 10, and thereby the pressure difference between the exterior and interior of storage container 10 is eliminated, accordingly, when storage container 10 is opened, fine particles such as toner stored in storage container 10 are not expelled so that staining does not happen.

Still further, the present invention makes it possible to prolong the durability of storage container 10 by the above-mentioned structure, though the gas ejecting means is provided onto storage container 10. Still further, the present invention makes it possible to provide storage container 10 with high economical efficiency without a raise in cost, as well as to provide storage container 10 in which the toner or fine particles are stored, having no deterioration of the quality of the toner or fine particles.

In storage container 10 related to the present invention, the gas is expelled only when the pressure difference between the exterior and interior of storage container 10 exceeds a certain value. Therefore, it is possible to maintain the quality of the fine particles product for a long time, which are stored in storage container 10 whose air tightness is not reduced.

Storage container 10 related to the present invention is arbitrarily chosen in accordance with the type, amount, and characteristic of the fine particles or grainy materials stored in storage container 10. Further, storage container 10 can be arbitrarily configured in accordance with the type, physicality, and durability of the structural materials of storage container 10. Accordingly, though storage container 10 is targeted for storing toner, when storage container 10 is made of material which cannot satisfy the characteristics considered in the present invention, it is possible to expel the extra gas in storage container 10, at the stage where the pressure difference between the exterior and inferior of storage container 10 does not reach the prescribed pressure.

Concerning the concrete example of the gas expelling means employed in storage container 10 of the present invention, it is proposed to arrange the grooves on the surface of the member which structures storage container 10 itself. In the case of storage container 10 of the present invention, though the grooves are formed on the surface of the member, the number of parts or manufacturing processes are not increased. That is, by only changing design wherein the grooves for expelling the gas are formed on the resin molding die for manufacturing storage container 10, it is clearly possible to manufacture a storage container which is superior in productivity and cost performance to the storage container which is manufactured by adding the parts such as a seal-typed member being permeable to air or an air permeable valve.

As stated above, due to research of the inventors of the present invention, since the size of the grooves in storage container 10 of the present invention depends upon the types of finely ground products which are stored in storage container 10, it was ascertained that the problem of the present invention was effectively realized by controlling the depth, width, shape, and length of the grooves.

Concerning the structure of the above-mentioned grooves, in the case of fine particles whose diameter is in the order of $\mu$m such as toner, the size of the grooves formed on the surface of the member can be measured by a stylus type surface roughness tester or understood by a microphotography, and the various measuring methods can be used, according to the diameters of fine particles. For example, a magnifying lens can be used for particles having relatively large diameters.

As understood by the above description, though the diameter of toner particles stored in storage container 10 is from several Am to ten-odd $\mu$m, the grooves formed in storage container 10 is larger than the toner particle, and further the toner particles can not escape through the grooves. It is not clear why the toner particles did not escape, and it is thought that probably the fine particles aggregate and support each other, forming bridges, and therefore the fine particles cannot pass through the grooves which are larger than the fine particles, and still further it is thought that probably the gas in the storage container is ejected to the exterior through the narrow clearances which are formed by the aggregated and bridged fine particles.

In storage container 10 related to the present invention, it is understood that the gas can certainly be ejected to the exterior, while the fine particles can be stored. That is, it is thought that the extra gas in storage container 10 is ejected to the exterior and filtered by the aggregated and bridged fine particles.

Concerning storage container 10 for storing the toner of the present invention, as mentioned above, the width, depth, and shape of the groove can be configured in accordance with the type, shape, size, and characteristics of the fine particles to be stored.

Further, the present invention does not specifically limit the part forming the gas ejecting means, that is, it is preferable that the grooves are formed at the part which has the strength of a structural member of storage container 10, and barely deforms, still further, the part whose distance between the exterior and interior of the storage container 10 is relatively short. For example, it is quoted that the grooves are formed on one of the fitting sections of the structural members which form the jointing sections of storage container 10.

As an example of the part where the gas ejecting means of storage container 10 of the present invention is to be formed, it has shown that the gas ejecting means can be formed on the lower edge section of toner ejecting cap 15 shown in FIG. 7(*b*), but the above part is not limited to this configuration.

Figure 14:
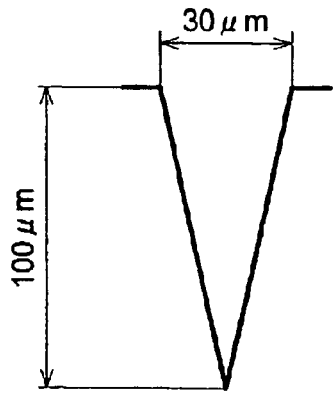
FIGS. 14(*a*) and 14(*b*) shows a groove which is V-shaped in the section.
Figure 14:
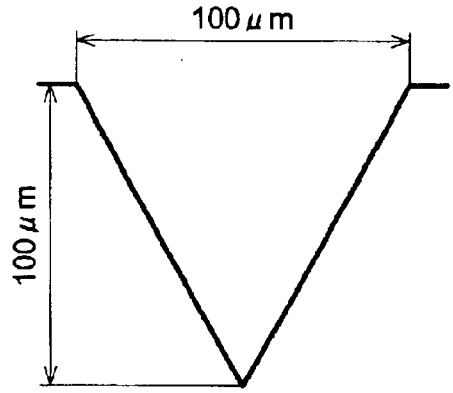

The gas ejecting means which is formed on storage container 10 of the present invention, is not limited to the above-mentioned grooves. For the gas ejecting means, it is possible to employ a means which can establish the condition wherein the gas can penetrate from the interior to the exterior of the capped and airtight storage container 10. In addition the above-mentioned grooves, it goes without saying that a part can be used having continuous nonlinear grooves like a satin finished surface, meshed grooves, or a surface having small tunnel-shaped porosities. The grooves are not limited to be straight ones. Further, the inventers studied a groove which was V-shaped in the sectional view as shown in FIGS. 14(*a*) and 14(*b*). That is, in FIG. 14(*a*), the V-shaped groove with the width of 30 $\mu$m and the depth of 100 $\mu$m is efficient, when the diameter of toner is 6.5 $\mu$m, but in FIG. 14(*b*), the V-shaped groove with the width of 100 $\mu$m and the depth of 100 $\mu$m is inefficient.

FIG. 13 is a sectional view of the toner supplying device 5 into which a toner storage container 10 is loaded.

In order to supply the toner into developing device 4, storage container 10 of the present invention is rotated around the cylindrical central axis by a rotation transmission member. By the rotation of storage container 10, concave spiral grooves 111 convey the toner to toner ejecting outlet 28. Since there are several concave spiral grooves 111 near toner supplying mouth section 12, the toner can be conveyed very smoothly, and even when the remaining toner in storage container 10 is reduced, the remaining toner can still be conveyed smoothly to developing device 4.

Further, as shown in FIG. 1, on the peripheral surface of storage container 10, straight groove 112, crossing over spiral grooves 111, is aligned with the axis of main container body 11 (that is, straight groove 112 is formed in the axial direction of the cylindrical container). Projected section 24 corresponding to straight groove 112 is formed at the entrance section of container supporting member 20 through which storage container 10 is inserted.

When straight groove 112 of storage container 10 is adjusted to projected section 24 which is formed on the entrance section of container supporting member 20, storage container 10 is inserted into container supporting member 20, with straight groove 112 aligned with projected section 24.

In this case, straight groove 112 of storage container 10 is changeable in accordance with the color or types of toner, and the position of projected section 24 which is formed on the entrance section of container supporting member 20, also depends upon the color and the types of toner which is used in developing device 4.

Only when toner used in developing device 4 agrees with the toner stored in storage container 10, the position and shape of straight concave 112 of storage container 10 agree with those of projected section 24 formed on the entrance section of container supporting member 20, and by adjusting and guiding straight concave 112 to projected section 24, it is possible to insert storage container 10 into container supporting member 20.

On the other hand, when toner used in developing device 4 does not agree with the toner stored in storage container 10, the position and shape of straight groove 112 do not agree with those of projected section 24, and thereby, miss-insertion of storage container 10 into container supporting section is prevented, as a result, miss-setting of storage container 10 is prevented.

The toner supplying device of the present invention is structured as a part of developing device 4, and is composed of storage container 10, container supporting member 20, and rotation transmission member 21 which transmits the rotation to storage container 10.

Rotation transmission member 21 is composed of gear assembly G which is rotated by motor M, and coupling member 23 having rotation shaft 27 connected to last gear 22 of gear assembly G. When storage container 10 is inserted into container supporting member 20, storage container 10 is coupled to coupling member 23 at toner supplying mouth section 12 of storage container 10, after which storage container 10 is rotated by the rotating motion of coupling member 23. Storage container 10 is rotated when the amount of toner or the density of toner becomes insufficient. By the rotation of storage container 10, the toner stored in storage container 10 is supplied to developing device 4 through toner ejecting outlet 28 of projected section 24 of storage container 10.

Coupling member 23 is composed of coupling claw, rotation shaft 27 engaged to last gear 22, and interior bellows cap 16. When top edge section 15*a* of toner ejecting cap 15, which is the top of storage container 10, is inserted into coupling member 23, claw 26 pushes interior bellows cap 16 to main container body 11, and interior bellows cap 16 is moved to the open position, after which toner ejecting outlet is opened. That is, storage container 10 is communicated to developing device 4 through toner ejecting outlet 28, in this way, the installation of storage container 10 is completed.

Accordingly, when storage container 10 is installed into a plain paper copier, by only removing cap 13 which covers toner supply mouth section 12, without releasing interior bellows cap 16, the expelling of toner is prevented, and further the operator's clothes are prevented from being stained.

Further when storage container is removed from container supporting member 20, interior bellows cap 16 is returned to the initial closed condition, after which toner ejecting outlet is covered by interior bellows cap 16, and thereby the expelling of toner attached at the top of storage container 10 is prevented, and the operators hands or clothes are not stained.

Effects of the present invention are as follows. According to the present invention, when there is a difference of pressure between the interior and the exterior of the container, extra gas in the container is released, and the pressure difference between the interior and the exterior of the container is moderately reduced to prevent the expelling of the fine particles by the present invention. Further, the present invention can provide a fine particle storage container which does not generate stains caused by the expelling of the fine particles, and still further, a toner storage container which does not generate stains caused by expelled toner.

That is, under high temperature environments which causes difference of pressure between the exterior and interior of the storage container, for the storage container in which the fine particles such as toner, the present invention produces the gas ejecting means which can rapidly and smoothly eject extra gas in the container to the exterior, when the pressure difference between the interior and exterior of the storage container exceeds a certain set value. Further, the present invention prevents expelling of toner when the storage container is opened, and further, makes it possible to provide a fine particles storage container which does not produce stains due to stray fine particles, and a toner storage container which des not produce stains due to toner.

Still further, by the present invention, the storage container is manufactured by molding dies having a means for reducing the difference of pressure between the exterior and interior of the storage container. Accordingly, the quality of the stored products of the fine particles can be maintained for a long time, and the present invention makes it possible to provide a fine particles storage container and a toner storage container manufactured without an increase in the number of parts.

What is claimed is:

1. A fine particle storage container, comprising;

a first surface member on which plural grooves are carved in a radial pattern, and the plural grooves penetrate the first surface member from an interior side to a periphery, and a second surface member to be firmly fitted to the first surface member to seal the fine particle storage container, wherein gas in the fine particle storage container is ejected to the exterior of the fine particle storage container through the plural grooves, though fine particles are not ejected through the plural grooves.

2. The fine particle storage container of claim 1, wherein the width of the groove gradually tapers toward the periphery from the interior on the first surface member.

3. The fine particle storage container of claim 1, wherein the groove gradually becomes shallower from the interior to the periphery of the first surface member.

4. The fine particle storage container of claim 1, wherein the width and depth of the groove is greater than the diameter of the fine particle stored in the fine particle storage container.

5. A fine particles storage product, comprising the fine particle storage container described in claim 1.

6. A toner storage container, further comprising;

a main container body for storing toner, and an interior cap member which is firmly fitted onto the main container body, wherein plural grooves are formed on one of fitting surfaces of the main container body and the interior cap member, to eject gas from an interior to an exterior of the main container body.

7. The toner storage container of claim 6, wherein the width of the groove gradually tapers from the interior to the exterior of the toner storage container.

8. The toner storage container of claim 6, wherein the depth of the groove gradually tapers from the interior to the exterior of the toner storage container.

9. The toner storage container in claim 6, wherein the width and depth of the grooved section is greater than the diameter of toner stored in the toner storage container.

10. A toner storage product, comprising the toner storage container described in claim 6.

11. A toner supplying device, wherein the toner storage container described in claim 6 is loaded, and wherein the toner supplying device supplies toner from the toner storage container to a developing device.

12. The toner storage container in claim 6, wherein the groove is V-shaped in a sectional view.

13. The toner storage container in claim 6, wherein the groove is U-shaped in a sectional view.

* * * * *